US007167144B2

(12) United States Patent
Tessier

(10) Patent No.: US 7,167,144 B2
(45) Date of Patent: Jan. 23, 2007

(54) METHOD FOR MONITORING A PLASMA DISPLAY PANEL WITH DISCHARGE BETWEEN TRIAD-MOUNTED ELECTRODES

(75) Inventor: Laurent Tessier, Fontaine (FR)

(73) Assignee: Thomson Licensing, Boulogne-Billancourt (FR)

( * ) Notice: Subject to any disclaimer, the term of this patent is extended or adjusted under 35 U.S.C. 154(b) by 344 days.

(21) Appl. No.: 10/479,695

(22) PCT Filed: Jun. 4, 2002

(86) PCT No.: PCT/FR02/01870

§ 371 (c)(1),
(2), (4) Date: Dec. 4, 2003

(87) PCT Pub. No.: WO02/101703

PCT Pub. Date: Dec. 19, 2002

(65) Prior Publication Data

US 2004/0160390 A1 Aug. 19, 2004

(30) Foreign Application Priority Data

Jun. 13, 2001 (FR) ..... 01 07707

(51) Int. Cl.
*G09G 3/28* (2006.01)

(52) U.S. Cl. ..... 345/60; 313/484; 313/491; 313/494; 345/67; 345/68

(58) Field of Classification Search ..... 313/491, 313/494; 345/67, 68, 60
See application file for complete search history.

(56) References Cited

U.S. PATENT DOCUMENTS

| | | | | |
|---|---|---|---|---|
| 6,288,692 | B1 | 9/2001 | Kanazawa et al. | 345/67 |
| 6,414,656 | B1 * | 7/2002 | Hong | 345/60 |
| 6,531,995 | B1 * | 3/2003 | Ishii et al. | 345/67 |

FOREIGN PATENT DOCUMENTS

| | | |
|---|---|---|
| FR | 2758641 | 7/1998 |
| FR | 2790583 | 9/2000 |

* cited by examiner

*Primary Examiner*—Amr A. Awad
*Assistant Examiner*—Michael Pervan
(74) *Attorney, Agent, or Firm*—Joseph J. Laks; Harvey D. Fried; Patricia Verlangieri

(57) ABSTRACT

The invention concerns a plasma panel display wherein the coplanar faceplate of the display panel comprising electrode triads including each two opposite side electrodes and a central electrode, and wherein during sustain operations by application of a series of sustain voltage pulses between the electrode triads, the central electrode always acts as anode. Such an arrangement, and preferably at an adapted width of the central electrode, enables to enhance substantially the luminous efficacy of the display panel.

13 Claims, 9 Drawing Sheets

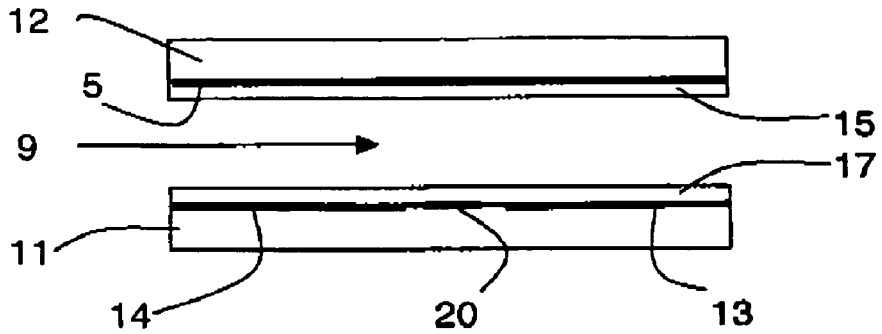
Fig.1 – PRIOR ART
Fig.2 A
PRIOR ART
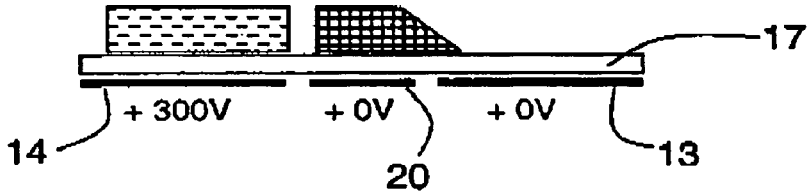
Fig.2 B1
PRIOR ART
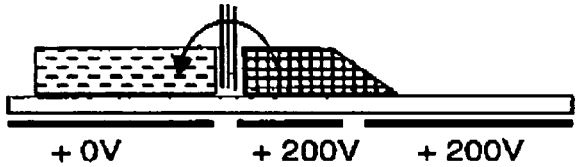
Fig.2 C1
PRIOR ART
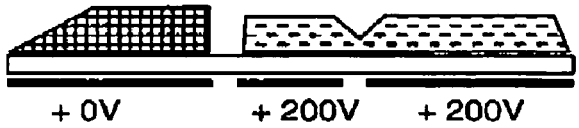
Fig.2 B2
PRIOR ART
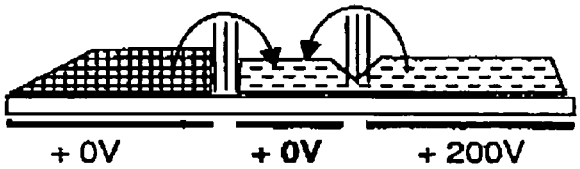
Fig.2 C2
PRIOR ART
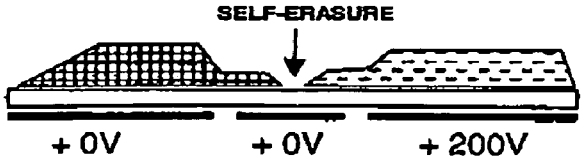

Fig.2 D1
PRIOR ART
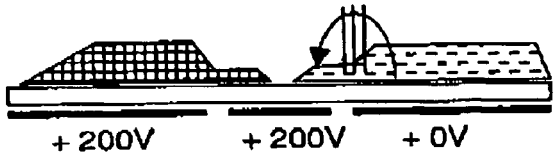
Fig.2 F1
PRIOR ART
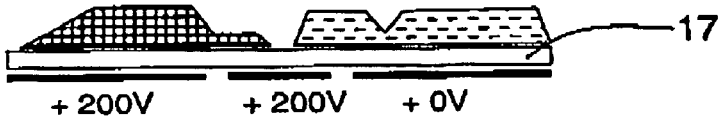
Fig.2 D2
PRIOR ART
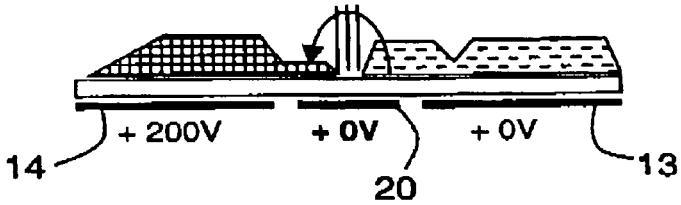
Fig.2 F2
PRIOR ART
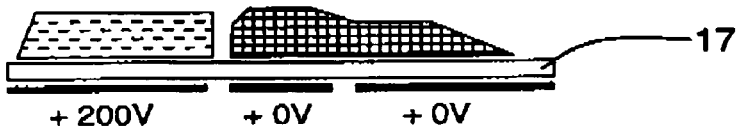
Fig.2 G1
PRIOR ART
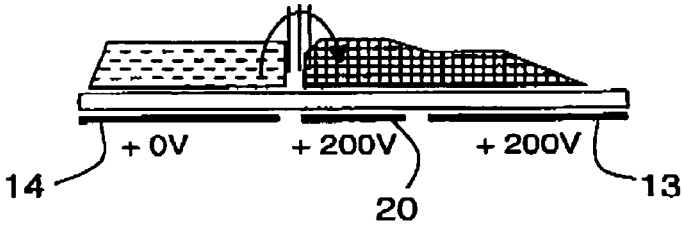
Fig.2 H1
PRIOR ART
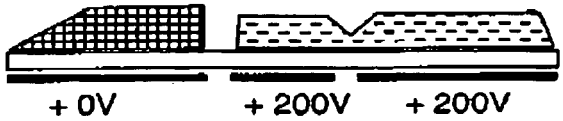

– PRIOR ART -

METHOD FOR MONITORING A PLASMA DISPLAY PANEL WITH DISCHARGE BETWEEN TRIAD-MOUNTED ELECTRODES

CROSS-REFERENCE TO RELATED APPLICATIONS

This application claims the benefit, under 35 U.S.C. § 365 of International Application PCT/FR02/01870, filed Jun. 4, 2002, which was published in accordance with PCT Article 21(2) on Dec. 19, 2002 in French and which claims the benefit of French patent application No. 0107707, filed Jun. 13, 2001.

BACKGROUND OF THE INVENTION

With reference to document FR 2 790 583 (SAMSUNG), especially to FIG. 4 of that document reproduced schematically hereinbelow in FIG. 1, the invention relates to a method for driving an AC image-display plasma panel with coplanar sustain discharges, and with memory effect, of the type comprising:

- a front tile and a rear tile, which are parallel and provide between them a space filled with a discharge gas;
- one 12 of the tiles comprising at least a first array of electrodes 5 and the other tile 11 comprising at least a second array of triads of electrodes 13, 20, 14, the general direction of which is approximately orthogonal to that of the electrodes 5 of the first array;
- the spaces located at the intersections of the electrodes 5 of the first array with the triads of electrodes 13, 20, 14 of the second electrode array forming a matrix of light-discharge regions 9 and of dots of the image to be displayed;
- the electrodes 13, 20, 14 of the triads being coated with a dielectric layer 17 in order to obtain the conventional memory effect whereby a discharge may be generated between these electrodes by applying a voltage below the ignition voltage.

In general, the walls of adjacent discharge regions are partially fitted with phosphors emitting different colours when they are excited by the ultraviolet radiation from the discharges; thus, the adjacent dots corresponding to these regions of different colours are combined into pixels or picture elements of the image to be displayed.

In general, the discharge regions, at least those of different colours, are separated by barriers.

The abovementioned memory effect is obtained in a discharge region 9 once charges are deposited on the surface of the dielectric 17 in this region, especially by applying a pulse called the address pulse between the electrode 5 and at least one of the opposed electrodes of the triad 14, 20, 13 which intersect in this region; the dielectric layer is generally coated with a protective layer which also emits secondary electrons, for example an MgO-based layer.

To obtain a succession of sustain discharges in the regions thus "addressed", the driving method described in that document comprises:

- conventionally, the application of at least one series of sustain voltage pulses between the opposed electrodes 13, 14 of each triad so as to generate sustain discharges in each of the "addressed" intersection regions 9, that is to say that in which it is desired to sustain a discharge;
- furthermore, at a time prior to (claim 3) or at the same time (claim 6) as the time when a sustain pulse of this series was applied, application of a pulse to the central electrode 20 of the said triad so as:
  - either (claim 4) to raise the potential of the central electrode 20 to the level of the higher potential [central=anode] of the two opposed electrodes 13, 14 at the moment of the said sustain pulse generating a sustain light discharge and then, when the said discharge decreases, to lower the potential of this central electrode 20 to the level of the lower potential of the two opposed electrodes 13, 14 [central=cathode],
  - or (claim 5) to lower the potential of the central electrode 20 to the level of the lower potential [central=cathode] of the two opposed electrodes 13, 14 at the moment of the said sustain pulse generating a sustain light discharge and then, when the said discharge decreases, to raise the potential of this central electrode 20 to the level of the higher potential of the two opposed electrodes 13, 14 [central=anode].

The timing diagrams corresponding to the staggering of the pulses and of the discharges are shown, on the one hand, in FIGS. 5 and 6 and, on the other hand, in FIGS. 8 and 9 of that document.

Again according to that document FR 2 790 583, the central electrode 20 must be thin so as not increase the electrostatic capacitance of the sustain electrodes of each triad.

In coplanar sustain-discharge plasma panels, the discharges occur by charge transfer across the region 9 onto the inner surface of the dielectric layer 17 of the tile 11 bearing the coplanar electrodes, in this case the triads 13, 20, 14; a description will now be given of the various charge transfer steps which optionally give rise to sustain light discharges in the case of the driving of a panel like the one described in document FR 2 790 583 and reference will be made to the appended FIGS. 2A to 2H1 in which the regions filled with "–" symbols represent negative charges or electrons on the surface of the dielectric 17 and in which the chequered regions correspond to positive charges or ions on the surface of the dielectric 17:

- after a conventional address pulse applied to an intersection of an electrode 5 of the first array with a triad of electrodes 13, 20, 14 of the second electrode array, between this address electrode 5 and at least one electrode of this triad, the charge distribution illustrated in FIG. 2A is obtained, the electrode 14 being raised to +300 V with respect to the other electrodes 20 (0 V) and 13 (0 V); electrons therefore accumulate on a lateral electrode of the triad and ions accumulate mainly on the central electrode of the triad;
- as in a conventional sustain sequence, the potentials of the two lateral electrodes are reversed and the electrode 13 is raised to +200 V with respect to the opposed lateral electrode 14 (0 V); at the moment of application of this first sustain pulse, the potential of the central electrode 20 is then raised to the level of the higher potential of the two opposed electrodes 13, 14, i.e. in this case 200 V, and the central electrode then acts as anode; this results in the configuration illustrated in FIG. 2B1 and a first main sustain light discharge occurs (see arrow) which causes the charge reversal shown in FIG. 2C1; during this charge reversal, the electrons spread out over the width of the central electrode 20 and over that of the lateral electrode 13, thereby giving rise to a substantial extension of the positive pseudocolumn of the plasma and therefore to a discharge of high luminous efficiency;

then, when this discharge decreases, the potential of the central electrode 20 is lowered to the level of the lower potential of the two opposed electrodes 13, 14 (in this case 0 V), and the central electrode then acts as cathode, as shown in FIG. 2B2; the movement (arrows) of the charges which is then initiated generates a first secondary sustain light discharge and results in the charge distribution shown in FIG. 2C2; this discharge has a poor luminous efficiency as it does not give rise to significant and extensive spreading of the electrons;

the second sustain pulse is now applied, by again reversing the potentials of the two lateral electrodes; the electrode 14 is now raised to +200 V with respect to the opposed lateral electrode 13 (0 V); at the moment of application of this second sustain pulse, the potential of the central electrode 20 is then again raised to the level of the higher potential of the two opposed electrodes 13, 14, i.e. in this case 200 V, and the central electrode then acts as anode; this results in the configuration illustrated in FIG. 2D1; the second main sustain light discharge (see arrow) awaited has barely taken place, as the central region of the surface of the dielectric has been greatly discharged and the memory effect is partly lost; the preceding sequence has therefore resulted in self-erasure; the resulting charge configuration is very little modified (FIG. 2F1);

next, the potential of the central electrode 20 is again lowered to the level of the lower potential of the two opposed electrodes 13, 14, in this case 0 V, and the central electrode then acts as cathode, as shown in FIG. 2D2; the movement (arrows) of the charges which is initiated then generates a second secondary sustain light discharge and results in the charge distribution shown in FIG. 2F2; this discharge has a poor luminous efficiency, as the spreading to which this gives rise relates in this case to ions;

after this first complete sustain cycle comprising two main sustain pulses, a second cycle is then initiated; the first sustain pulse of the second cycle is thus applied by again reversing the potentials of the two lateral electrodes; the electrode 13 is now raised to +200 V with respect to the opposed lateral electrode 14 (0 V); at the moment of application of this sustain pulse, the potential of the central electrode 20 is then again raised to the level of the lower potential of the two opposed electrodes 13, 14, i.e. in this case 200 V, and the central electrode acts as anode; this results in the configuration illustrated in FIG. 2G1 and a new main sustain like discharge occurs (see arrow) which causes the charge reversal shown in FIG. 2H1, identical to FIG. 2C1 showing the end of the first sustain discharge; during this charge reversal, the electrons spread out over the width of the central electrode and over that of the lateral electrode 13, giving rise to an extensive elongation of the positive pseudocolumn of the plasma and therefore to a discharge of high luminous efficiency.

The second sustain cycle then continues like the first cycle and the movements of the charges are identical to those of the first cycle: from the end of this first main sustain discharge of the second cycle (FIG. 2C1 identical to 2H1), there follow in succession a secondary discharge of low efficiency resulting in self-erasure (FIGS. 2B2 and 2C2), a very low main sustain discharge (FIGS. 2D1 and 2F1) and finally another secondary discharge of low efficiency (FIGS. 2D2 and 2F2).

Where appropriate, further identical sustain cycles then follow in succession until exhaustion of the desired sustain duration, and the voltage pulses applied to the electrodes form a series of sustain pulses.

It may therefore be seen that, over a complete cycle comprising two main sustain pulses and two secondary sustain pulses, only one discharge has a high luminous efficiency; overall, the luminous efficiency of the plasma panel is therefore unsatisfactory when arrays of electrode triads and the driving method described in document FR 2 790 583 are used for coplanar display.

It may therefore be seen that, in a series of sustain pulses, the central electrode acts alternately as anode and cathode.

Moreover, the small width of the central electrode of these triads, like that described and recommended in document FR 2 790 583, limits the possibility of electrons spreading and the possibility of extension of the positive pseudocolumn of the plasma, thereby making no improvement to the luminous efficiency compared with the conventional coplanar configurations, the improvement in luminous efficiency not being, moreover, the objective pursued by that document.

The object of the invention is to provide a coplanar plasma panel structure and a method of driving the sustain pulses for this panel which substantially improve the luminous efficiency; the object of the invention is in particular to avoid the aforementioned drawbacks.

SUMMARY OF THE INVENTION

For this purpose, the subject of the invention is a method for driving an AC image-display plasma panel with coplanar sustain discharges, and with memory effect, the said panel comprising:

a front tile and a rear tile, which are parallel and provide between them a space filled with a discharge gas;

one of the tiles comprising at least a first array of electrodes and the other tile comprising at least a second array of triads of electrodes, the general direction of which is approximately orthogonal to that of the electrodes of the first array;

each triad comprising two opposed lateral electrodes and one central electrode;

the spaces located at the intersections of the electrodes of the first array with the triads of electrodes of the second electrode array forming a matrix of light-discharge regions and of dots of the image to be displayed;

the electrodes of the triads being coated with a dielectric layer;

the said method comprising at least one sustain operation by applying a series of sustain voltage pulses between the electrodes of each triad so as to generate sustain discharges in each of the intersection regions in which it is desired to sustain a light discharge, characterized in that, during the said sustain operation, the central electrodes of each triad always act as anode.

By virtue of this arrangement, the luminous efficiency of the panel is substantially improved; according to the invention, and contrary to the driving methods described in document FR 2 790 583 already mentioned, throughout the entire duration of the sustain operations (or "display phases"), the potential of the central electrode is always strictly higher than that of one or other of the lateral electrodes so that this central electrode always acts as anode.

One advantageous means of making the central electrode act as anode throughout the sustain operation (or through the display phases) consists in making this electrode a floating electrode; this is because, by the principle of a capacitive divider bridge, in such a configuration the central electrode then has a potential lying between the potential of the two adjacent lateral electrodes so that this potential of the central electrode is always strictly higher than that of one or other of the lateral electrodes. The economic advantage of such a configuration is that it does not require a specific sustain supply for the central electrodes of the panel nor switches or drivers for supplying them.

To obtain an even greater improvement in the luminous efficiency, it is preferable, contrary to the teachings of the aforementioned document FR 2 790 583, for the central electrode to have a width large enough to favour electron spreading and extension of the positive pseudocolumn of the plasma during sustain discharges; preferably, the width of this central electrode is greater than the gaps separating and isolating the adjacent electrodes of the same triad; if both gaps of the same triad were to have different values, the width of the central electrode is greater than the larger gap; preferably, the width of this central electrode is greater than 80 μm.

The width of this central electrode may especially be between 100 and 200 μm.

Advantageously, the central electrode may even be wider than 200 μm; particularly, in this case, there is then a risk of a matrix ignition of discharges, that is to say ignition of these discharges not between the electrodes of the triad (the coplanar ignition case), but between an electrode of the first array belonging to one tile and an electrode of a triad belonging to the other tile; it is sought to avoid matrix ignition because, contrary to coplanar ignition, this fluctuates greatly from one cell of the panel to another depending on the electrical characteristics of the materials of the walls of these cells, especially of the phosphors, which differ from one cell to another; these electrical characteristics include the permitivity, the static charge, the dielectric thickness and the secondary electron emission; in order to avoid or limit this matrix ignition, it is preferable that:

- the gaps separating and isolating the adjacent electrodes of the same triad are less than 80 μm, and
- the spacing between the tiles providing the discharge-gas-filled space is greater than 130 μm.

Advantageously, the width of the central electrode is then greater than the width of each of the lateral electrodes.

Between each series of sustain pulses, there are generally selective addressing or selective erasing operations; before a selective addressing operation, there is generally a priming operation and an erasing operation, both these being semi-selective or non-selective. For this purpose, the subject of the invention is also the above method according to the invention also comprising, before or after each sustain operation, a selective addressing or erasing operation applied only in each of the said regions in which it is desired to sustain a light discharge during the said series, by applying at least one voltage pulse between the electrode of the said first array crossing the said region and at least one of the electrodes of the triad crossing the said region.

In the case of an addressing operation, this takes place before each sustain operation and the corresponding address pulse is adapted in a manner known per se so as to generate electrical charges on the dielectric layer in the said region and thus obtain the well-known memory effect of plasma panels.

This method corresponds to a conventional mode of driving by selective addressing, which can be used in methods in which rows or groups of rows of discharge regions are addressed in succession before a display phase (cases called "ADS" or "ADM") or in methods in which rows or groups of rows are addressed while other rows or groups of rows are being displayed (the case called "AWD").

This method corresponds to a conventional mode of driving by selective addressing, which can be used in methods in which rows or groups of rows of discharge regions are addressed in succession before a display phase (cases called "ADS" or "ADM") or in methods in which rows or groups of rows are addressed while other rows or groups or rows are being displayed (the case called "AWD").

In the case of an erasing operation, this takes place after each sustain operation and the corresponding erase pulse is adapted in a manner known per se so as to remove the electrical charges on the dielectric layer in the said region and bring the memory effect to an end.

This method corresponds to a conventional mode of driving by selective erasure.

Preferably, the selective voltage pulse is applied between the electrode of the said first array crossing the said region and the central electrode of the triad crossing the said region.

By thus transferring all of the selective addressing or erasing operations to the central electrodes, it is possible to configure the lateral electrodes of series of adjacent discharge regions, to the point even of using common electrodes, for example as lower lateral electrode of a triad corresponding to a row n and as upper lateral electrode of the triad corresponding to the next adjacent row (n+1); thus, the subject of the invention is also a method according to the invention in which all of the regions supplied via the same triad forming one row of the said panel, on any two adjacent rows through which a first triad on the one hand and a second triad on the other hand pass respectively, the lateral electrode of the first triad is electrically connected to the same potential as the closest lateral electrode of the second triad.

Preferably, the said two electrically connected electrodes form an electrode common to two adjacent rows.

The subject of the invention is also a plasma panel that can be used to implement the method according to the invention, comprising:

- a front tile and a rear tile, which are parallel and provide between them a space filled with a discharge gas;
- one of the tiles comprising at least a first array of electrodes and the other tile comprising at least a second array of triads of electrodes, the general direction of which is approximately orthogonal to that of the electrodes of the first array;
- each triad comprising two opposed lateral electrodes and one central electrode;
- the spaces located at the intersections of the electrodes of the first array with the triads of electrodes of the second electrode array forming a matrix of light-discharge regions and of dots of the image to be displayed;
- the electrodes of the triads being coated with a dielectric layer;

means for controlling the discharges in each of the said intersection regions, especially by means of sustain operations;

characterized in that the said control means are designed so that, during the sustain operations, the central electrode always acts as anode.

In the case mentioned above in which the central electrodes are floating and there are no external connections, the panel includes no specific sustain supply for these electrodes nor drivers for supplying them.

Preferably, the width of the said central electrode is greater than the gaps separating and isolating the adjacent electrodes of the same triad; in practise, the width of the central electrode is greater than 80 μm; other preferences as regards the geometry of the electrodes and/or of the cells of the panel have already been mentioned especially the avantageous case in which the width of the central electrode is greater than the width of each of the lateral electrodes.

Preferably, all of the regions supplied via the same triad forming one row of the said panel, on any two adjacent rows through which a first triad on the one hand and a second triad on the other hand pass respectively, the lateral electrode of the first triad is electrically connected to the same potential as the closest lateral electrode of the second triad; preferably, the said two electrically connected electrodes form an electrode common to two adjacent rows.

BRIEF DESCRIPTION OF THE DRAWINGS

A greater understanding of the invention will be gained by reading the description which follows, given by way of non-limiting example, and with reference to the appended figures in which:

FIG. 1, already described, is a schematic sectional view of a cell having three coplanar electrodes of a plasma panel of the prior art, with the same references as FIG. 4 of document FR 2 790 583;

FIGS. 2A to 2H1 (no FIG. 2E), already described, illustrate the change in the electrical charges and the occurrence of the light discharges in a cell of FIG. 1 when it is driven according to the prior art as described in document FR 2 790 583;

To simplify the description and bring out the differences and advantages that the present invention has over the prior art, identical references are used for the elements which fulfil the same functions.

DETAILED DESCRIPTION

The plasma panel according to the invention is identical to that described above (FIG. 1) and that described in document FR 2 790 583 (FIG. 4) apart from the difference, which is essential for optimizing the luminous efficiency, that the central electrode 20 of each triad is wide enough to favour extension of the positive pseudocolumn of the plasma and spreading of the electrons during a light discharge; in practice, the width of this central electrode is greater than the gap separating the electrodes; thus, the width of this central electrode is greater than 50 μm, preferably greater than 80 μm; the width of the central electrode of each triad is generally between about 100 and 200 μm.

Figure 3A:
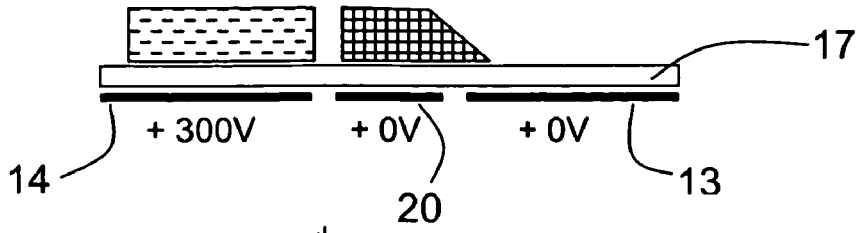
FIGS. 3A to 3F illustrate the change in the electrical charges and the occurrence of the light discharges in a cell similar to that of FIG. 1 but with a wider central electrode according to the invention, when it is driven according to one embodiment of the invention.
Figure 3B:
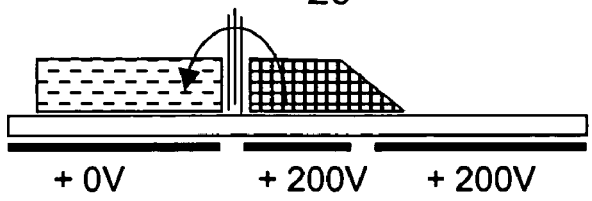
Figure 3C:
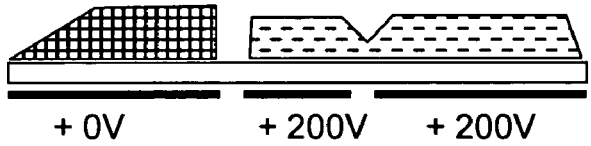
Figure 3D:
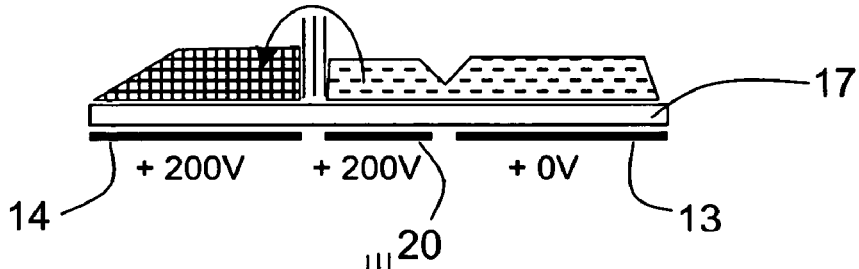
Figure 3E:
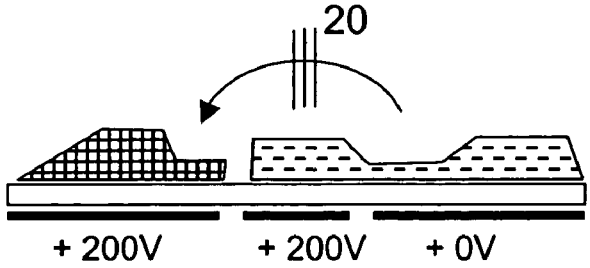
Figure 3F:
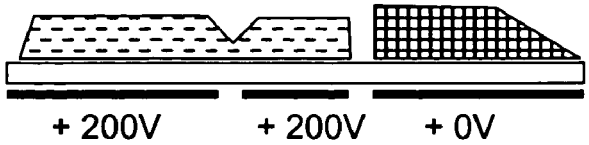

The method of driving the plasma panel according to the invention will now be described, especially in a sustain phase according to the invention, with reference to FIGS. 3A to 3F which show the change in the charges on the surface of the dielectric layer 17, with the same representational conventions as those for FIGS. 2A to 2H1:

- during a conventional address pulse applied to an intersection of an electrode 5 of the first array with a triad of electrodes 13, 20, 14 of the second electrode array, between this address electrode 5 and at least one electrode of this triad, the charge distribution illustrated in FIG. 3A is obtained after the address discharge, the lateral electrode 14 being raised to +300 V with respect to the other electrodes, namely the lateral electrode 13 (0 V) and the central electrode 20 (0 V); electrons therefore accumulate on a lateral electrode of the triad and ions build up mainly on the central electrode of the triad, which is wider than in the prior art;
- as in a conventional display sequence, the potentials of the two lateral electrodes are reversed and the electrode 13 is raised to +200 V with respect to the opposed lateral electrode 14 (0 V); at the moment of application of this first sustain pulse, the potential of the central electrode 20 is then raised to the level of the higher potential of the two opposed electrodes 13, 14, i.e. in this case 200 V, and is held at this value until the end of the first sustain pulse, contrary to the prior art; the central electrode then acts as anode; this results in the configuration illustrated in FIG. 3B and, as in the prior art, a first main sustain light discharge occurs (see arrow) which causes the charge reversal shown in FIG. 3C; during this charge reversal, the electrons spread out over the central electrode 20, which is much wider than in the prior art, and over the lateral electrode 13, thereby giving rise to a greater extension of the positive pseudocolumn of the plasma than in the prior art and therefore to a discharge of higher luminous efficiency;
- next, the second sustain pulse is applied, by again reversing the potentials of the two lateral electrodes; the electrode 14 is now raised to +200 V with respect to the opposed lateral electrode 13 (0 V); at the moment of application of this second sustain pulse, the potential of the central electrode 20 is again held at the level of the higher potential of the two opposed electrodes 13, 14, i.e. in this case 200 V; the central electrode still acts as anode; this results in the configuration illustrated in FIG. 3D and a second main sustain light discharge (see arrow) is initiated, which causes the charge reversal shown in FIG. 3F with a transient state shown in FIG. 3E; during this charge reversal, the electrons again spread out over the central electrode 20, which is much larger than in the prior art, and over the lateral electrode 14, thereby giving rise to a greater extension of the positive pseudocolumn of the plasma and therefore to a discharge of higher luminous efficiency;
- after this first complete sustain cycle, comprising only two main sustain pulses, a second cycle is then initiated; a first main sustain pulse of the second cycle is then applied by again reverse the potentials of the two lateral electrodes, but still without changing the potential of the central electrode 20; the electrode 13 is now raised to +200 V with respect to the opposed lateral electrode 14 (0 V) and the central electrode 20 still acts as anode; this configuration causes the charge reversal already shown in FIG. 3C, representing the end of the first sustain discharge of the second cycle, and the discharge obtained has a very high luminous efficiency as in the case of the first cycle.

The second sustain cycle then continues like the first cycle and the charge movements are identical to those of the first cycle: after the end of this first sustain discharge of the second cycle (FIG. 3C), there is a second sustain discharge of the second cycle (FIGS. 3D to 3F), which also has a very high luminous efficiency.

Where appropriate, further identical sustain cycles then follow in succession until exhaustion of the desired sustain duration and the voltage pulses applied to the electrodes form a series of sustain pulses.

It may therefore been seen that the series of sustain pulses cause only discharges of very high luminous efficiency; overall, the luminous efficiency of the plasma panel is therefore substantially improved and optimized by virtue of a driving system in which the central electrode always acts as anode and by virtue of the width of the central electrode, which is greater than in the prior art.

According to the invention, the discharge extension that is obtained makes it possible, in each region, to increase, within the plasma, the volume of the positive pseudocolumn in which there is a low electric field and in which the emission of ultraviolet photons is generated with a very high efficiency.

Figure 5A:
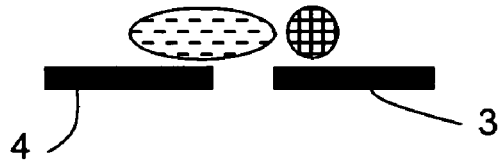
FIGS. 5A to 5C illustrate the spreading of the discharges in a cell having two coplanar electrodes of a plasma panel of the prior art, depending on a width of the coplanar electrodes and of the gap separating these electrodes.
Figure 5B:
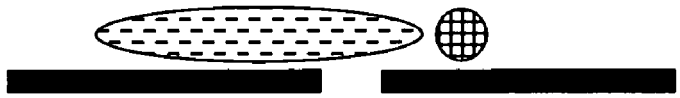
Figure 5C:
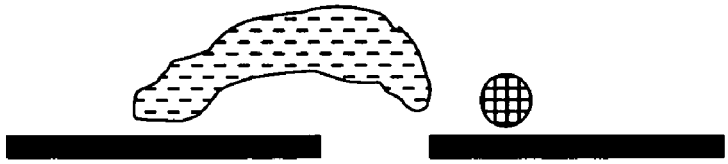

In the prior art of plasma panels provided with pairs of coplanar sustain electrodes 3, 4, as shown schematically in FIG. 5A, at least two means of improving the luminous efficiency are known:

by increasing the width of the electrodes of each pair, so as to elongate the discharge, as shown in FIG. 5B; but the risk of interference between various discharge regions (called crosstalk) imposes an upper limit on this width and therefore on the improvement in luminous efficiency;

by increasing the gap which separates the coplanar electrodes of a pair, so as to limit the electric field in the discharge regions; this then lengthens the discharge path in the depth of each region, as shown in FIG. 5C, because the field rows then assume the approximate shape of semi-circles (contrary to FIG. 5B in which the gap is too small); however, this increase in the gap unfavourably modifies the discharge ignition conditions (Paschen's law), requires higher ignition voltages and incurs prohibitive increases in costs of the electronic components; the need to be able to drive the panel with sufficiently low voltage pulses therefore considerably limits the increase in the gap.

The invention makes it possible to use both these means, while avoiding these limitations; the central electrode makes it possible to space out the two opposed coplanar electrodes without modifying the discharge ignition conditions.

Furthermore, the invention has the following advantages:

since the central electrode is held at the same potential throughout the sustain phase, the system for driving the panel is therefore very simple to operate, and therefore very economic;

since the central electrode is wider than in the prior art, this electrode is easy to produce and at a lower cost.

Figure 4:
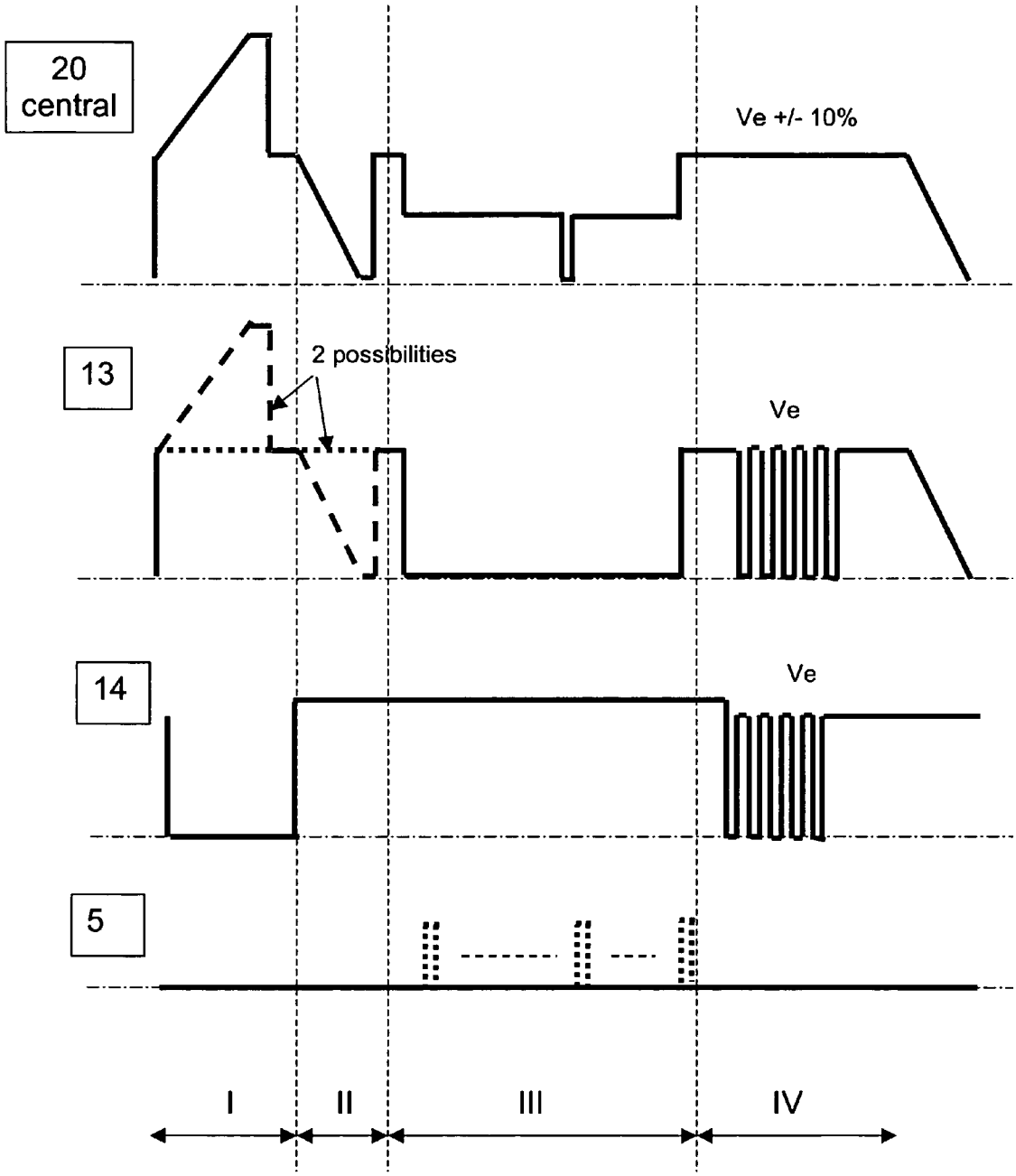
FIG. 4 illustrates schematically, by four timing diagrams labelled 20, 13, 14 and 5, the variation over time in the potential applied to the electrodes of a coplanar triad (lateral electrodes 13, 14 and central electrode 20) and to the address electrodes 5 according to one embodiment of the invention.

A description will now be given, with reference to FIG. 4, of a complete example of the ADS type of a scheme for a complete address/sustain cycle for the discharge regions of a plasma panel according to the invention:

in a first, non-selective phase I, called the priming phase, a uniformly increasing voltage, greater than that of the address electrode 5 of the first array, is applied to the central electrode 20 of the second coplanar array so as to generate a discharge called a "positive resistance" discharge between the central electrode 20 and a lateral electrode and thus produce the electrical charges called "primary charges" needed for the addressing phase, while generating a minimum amount of light emission in order to preserve good image contrast;

in a second, again non-selective phase II called the erase phase, without modifying the voltage of the address electrode 5, a uniformly decreasing voltage is applied to the central electrode 20 and a constant voltage is applied to only one 14 of the lateral electrodes, this constant voltage being designed always to be greater than that of the central electrode 20, so as to produce a discharge of low luminous efficiency in order to erase the electrical charges stored on the surface of the dielectric layer 17 during the previous priming operation;

in a third phase III, this time a selective phase called the address phase, address pulses are applied, on the one hand simultaneously to the various electrodes 5 of the first array and, on the other hand in succession to the various central electrodes 20 of the second array, while still keeping the voltage of the lateral electrode 14 at the same potential as in the previous phase and applying a voltage identical to the lowest voltage of the address electrode 5 to the other lateral electrode 13, while keeping, outside the address pulses, the voltage of the central electrode 20 between that of the two lateral electrodes 13, 14, so as to deposit electrical charges on the surface of the dielectric 17 in the regions in which it is desired to sustain electrical discharges in the next sustain phase;

in a final, non-selective, sustain phase IV, after having applied approximately the same positive voltage Ve to the three coplanar electrodes 13, 20, 14 while keeping the address electrodes 5 of the first array at zero voltage, a zero voltage is applied alternately to each lateral electrode 13, 14 without modifying the voltage of the central electrode 20; thus, this central electrode 20 acts as anode throughout the sustain phase; the voltage Ve is designed in a manner known per se to obtain discharges in the previously addressed regions without obtaining them in the non-addressed regions.

After this first sustain phase, a new address/sustain cycle may be repeated in a manner known per se in order to display images on an AC plasma panel with memory effect.

Thus, according to an advantageous variant of the invention, all of the selective address or erase operations are transferred to the central electrode; by virtue of this improvement, it is possible to group together and electrically connect each lateral electrode of a triad to the closest lateral electrode of the adjacent triad on the tile.

These two connected electrodes may now even form merely a single electrode 21 so that the total number of electrodes of the array of triads is reduced by one third; thus, the total number of electrodes of the second electrode array, or coplanar discharge array, is identical, to within one electrode, of the total number of electrodes of the coplanar arrays of the prior art, which are arrays of electrode pairs; nor is the manufacture of the plasma panel tiles and that of the driving means according to this variant therefore more expensive than that of the plasma panels with only two coplanar electrodes of the prior art.

A description will now be given of one embodiment of a plasma panel according to this advantageous variant, with reference to FIG. 6 which shows plasma panel discharge regions in which each pixel P comprises three adjacent discharge regions 9R, 9G, 9B, separated by barriers 16 extending from the dielectric layer 15 of the rear tile carrying the first electrode array 5 as far as the dielectric layer 17 of the front tile carrying the electrode triads 13, 20, 14; the adjacent triads 13, 20, 14 on the one hand and 13', 20' 14' (not shown) on the other are separated from each other by barriers 6 orthogonal to the barriers 16; the electrodes 5 of the first array are in this case offset and positioned beneath the barriers 16 and are provided with branch-offs 51 positioned in each discharge region 9R, 9G, 9B and extending towards the middle of this region; preferably the electrodes 5 of the first array are provided with means for promoting the formation of display discharges between each lateral electrode 13, 14 of a triad and the central electrode 20 of this same triad; it is preferable for there to be two branch-offs 51 per discharge region, these being positioned on either side of the central electrode 20; the barriers 6, 16 together with the dielectric layers 15, 17 define discharge cells; the walls of the discharge cells 9R, 9G, 9B, except that of the front tile, are coated with phosphors of different colors, red, green and blue respectively, suitable for emitting radiation of these colors when they are excited by the ultraviolet radiation emanating from the discharges; in the regions lying above the electrodes, the dielectric layers are generally coated with a thin protective layer which emits secondary electrons, generally an MgO-based layer.

According to the advantageous variant of the invention that has just been described, the lower lateral electrode 14 of the first triad, corresponding to a row n of the panel, is connected to the same bus 22' as the upper lateral electrode 13' of the second triad, adjacent to the first triad, corresponding in this case to the next row (n+1) of the panel; since each lateral triad electrode is shared between two adjacent rows, if N is the total number of rows in the panel, there are in total only 2N+1 electrodes in the coplanar array or second array, which simplifies the manufacture of the panel, each electrode being supplied by a central bus 20, 20', or by a lateral bus 22, 22'; the lateral buses 22, 22' are opaque and positioned in this case at the top of the barriers 6 in order not to obscure the emission of visible light emanating from the discharge regions 9R, 9G, 9B.

A lateral bus 22' then forms, with the two lateral electrodes 14 and 13' to which it is connected, one and the same electrode 21; all of the second array of electrodes or array of rows is formed from alternations of central electrodes 20, 20' which are used for the selective address or erase operations and of electrodes 21, common to two rows of adjacent discharge regions, which are not used for the selective address or erase operations.

Figure 6:
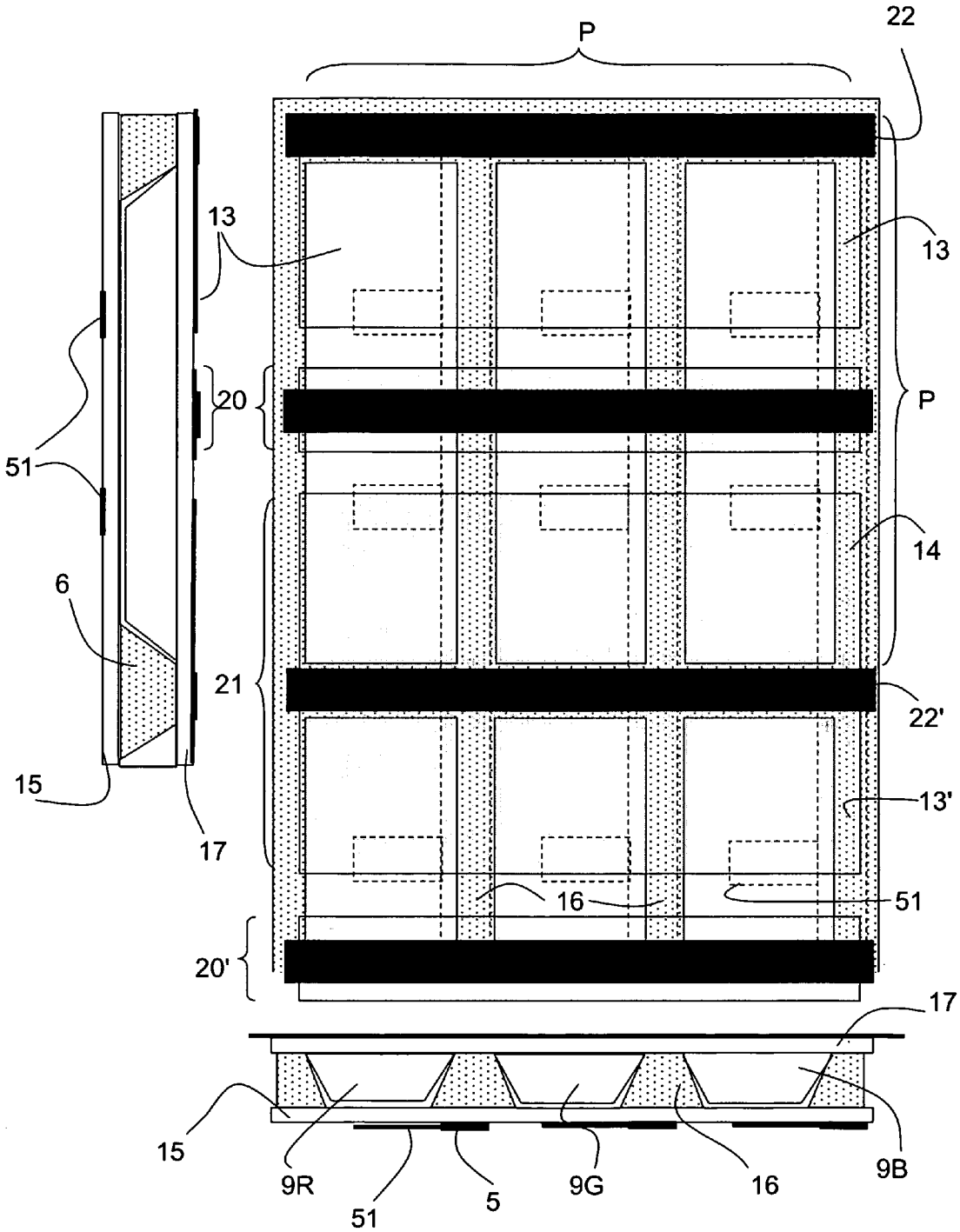
FIG. 6 shows a top view and two sectional side views of a group of three adjacent cells of different colours of a plasma panel according to one particular embodiment of the invention, in which each lateral electrode of a triad is common to two adjacent rows of the panel and is made of a transparent conducting material.

According to the embodiment illustrated in FIG. 6, the electrodes 13, 14, 13' are made of a transparent conducting material, for example tin oxide (SnO) or a mixed indium tin oxide (ITO), in order not to absorb the visible light emanating from the discharge regions 9R, 9G, 9B.

Figure 7:
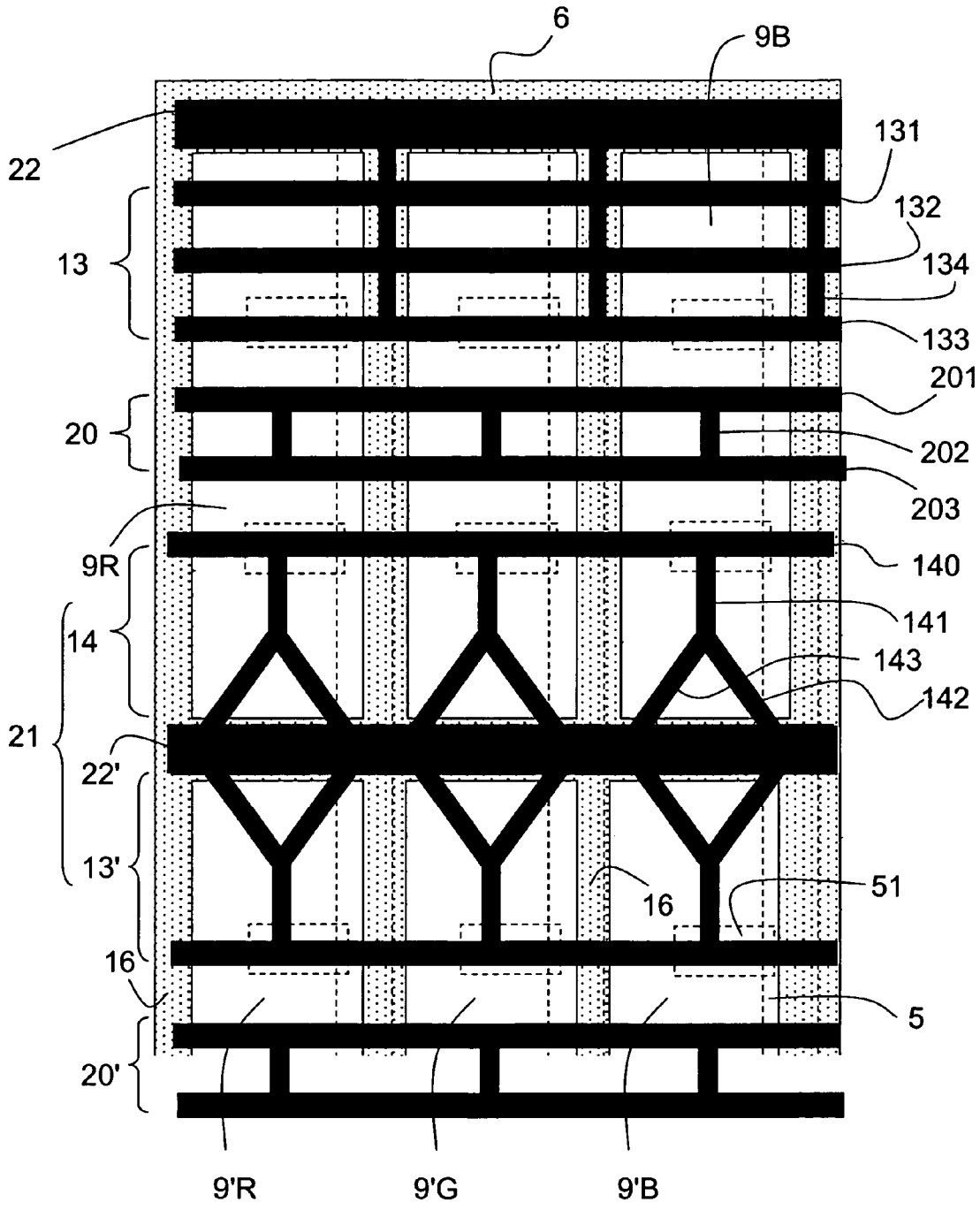
FIG. 7 shows a top view similar to that in FIG. 6, the only difference being that the lateral electrodes are formed from opaque conducting grids.

According to an alternative embodiment of the same type of plasma panel, shown in FIG. 7, the central electrodes 20, 20' or lateral electrodes 21 are formed from a subarray of opaque conductors arranged in a grid, for example:

the central electrode 20, 20' comprises two opaque parallel conductors 201, 203 each having a front defining one of the gaps and electrically connected together by opaque transverse branch-offs 202 placed at the centre of each cell 9R, 9G, 9B;

the electrode 14 supplying the cells 9R, 9G, 9B and the electrode 13' supplying the cells 9'R, 9'G, 9'B of the neighbouring row, both electrodes being connected to the same bus 22' in order to form the electrode 21 common to two successive rows, each comprise an opaque lateral conductor 140 having a front defining a gap and placed so as to be parallel to the conductors 201, 203 of the central electrode 20; each lateral conductor 140 is electrically connected to the bus 22' via opaque Y-shaped branch-offs placed at the centre of each cell 9R, 9G, 9B, 9'R, 9'G, 9'B; each Y-shaped branch-off comprises a main conductor 141 for the "foot" of the Y and two secondary conductors 142, 143 forming the "arms" of the Y; these branch-offs are connected to the bus 22' via the "arms" 142, 143, while they are connected at the other end to the lateral conductor 140 via the "feet" 141; such a Y-shaped arrangement of the branch-offs is advantageous for the variation in the length of discharge during a discharge and, consequently, for the luminous efficiency of the panel.

The grid arrangement of opaque conductors of the central electrodes 20, 20' and/or lateral electrodes 21 is more economic because it avoids the expensive use of transparent conducting materials, as in the previous embodiment in FIG. 6; the conductors and the branch-offs which form the grids have a width small enough to limit the obscuring of the discharge cells or regions but large enough to obtain the electrical conductivity needed to create the discharges.

Other shapes of grids may be used, such as that of the electrode 13 in FIG. 7, comprising three parallel conductors 131, 132, 133 connected together by transverse branch-offs 134 placed above the barrier 16 in order to limit obscuring of the cells.

Figure 8:
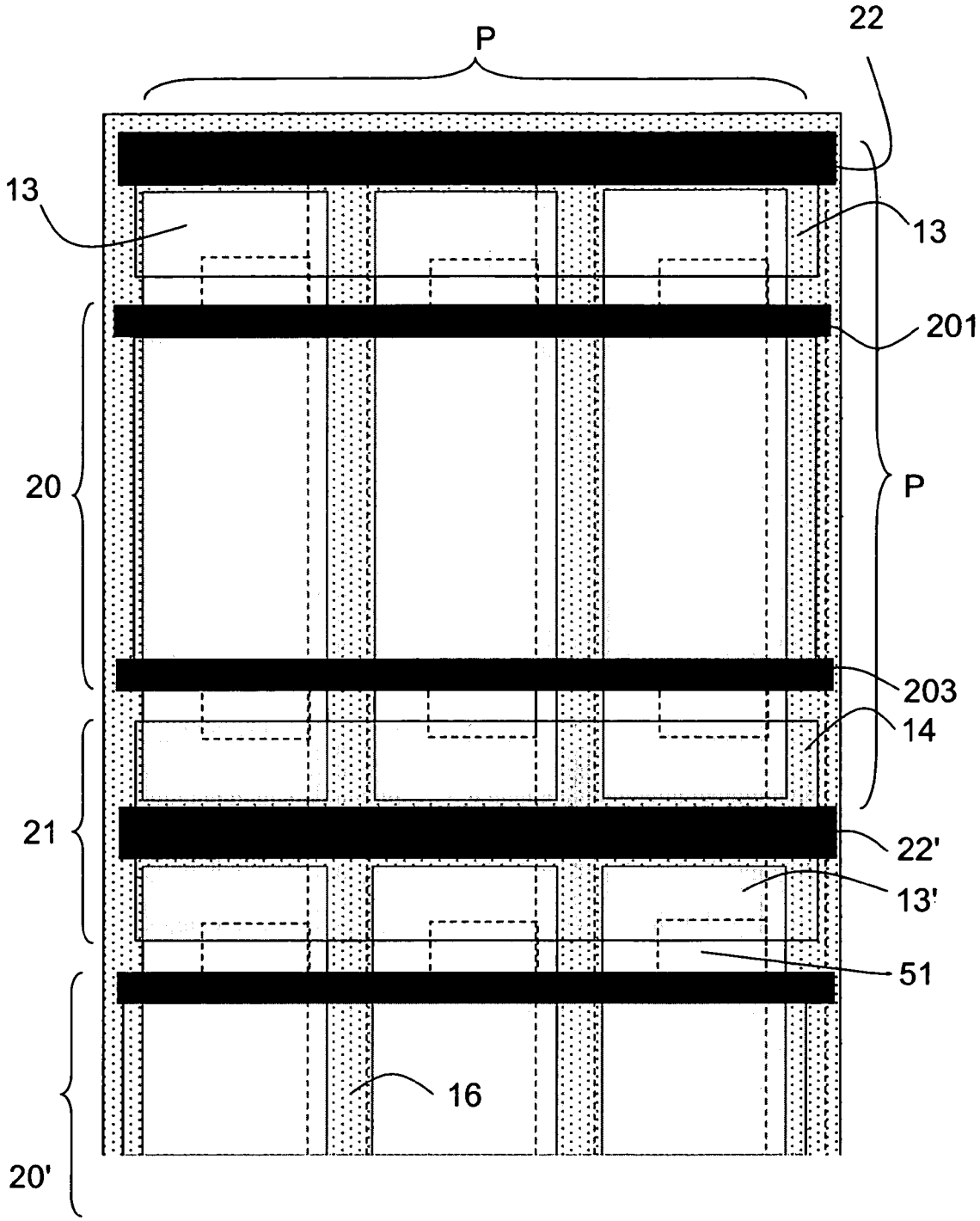
FIG. 8 shows a variant of FIG. 6 with a central electrode of large width provided with buses that are placed at the discharge ignition edges of this electrode.

FIG. 8 shows a variant of FIG. 6 (the same reference numbers of the components) with a central transparent electrode 20, the width of which is greater than that of each of the lateral electrodes 13 or 14, which central electrode is furthermore provided with two opaque conducting buses 201, 203 that are placed at the discharge ignition edges of this electrode; since the thickness of such conducting buses is generally greater than the thickness of the transparent part of the electrode, generally based on ITO, the thickness of the dielectric layer covering these buses is less than the thicknes of the dielectric layer covering the transparent part of the electrode; thus, as a result of the thickness of the dielectric layer being smaller at the ignition edges of the central electrode than the thickness between or away from the ignition edges, the discharge ignition voltage is advantageously lowered, any matrix discharge starting is avoided and coplanar ignition in accordance with one of the objectives of the invention is promoted.

Figure 9:
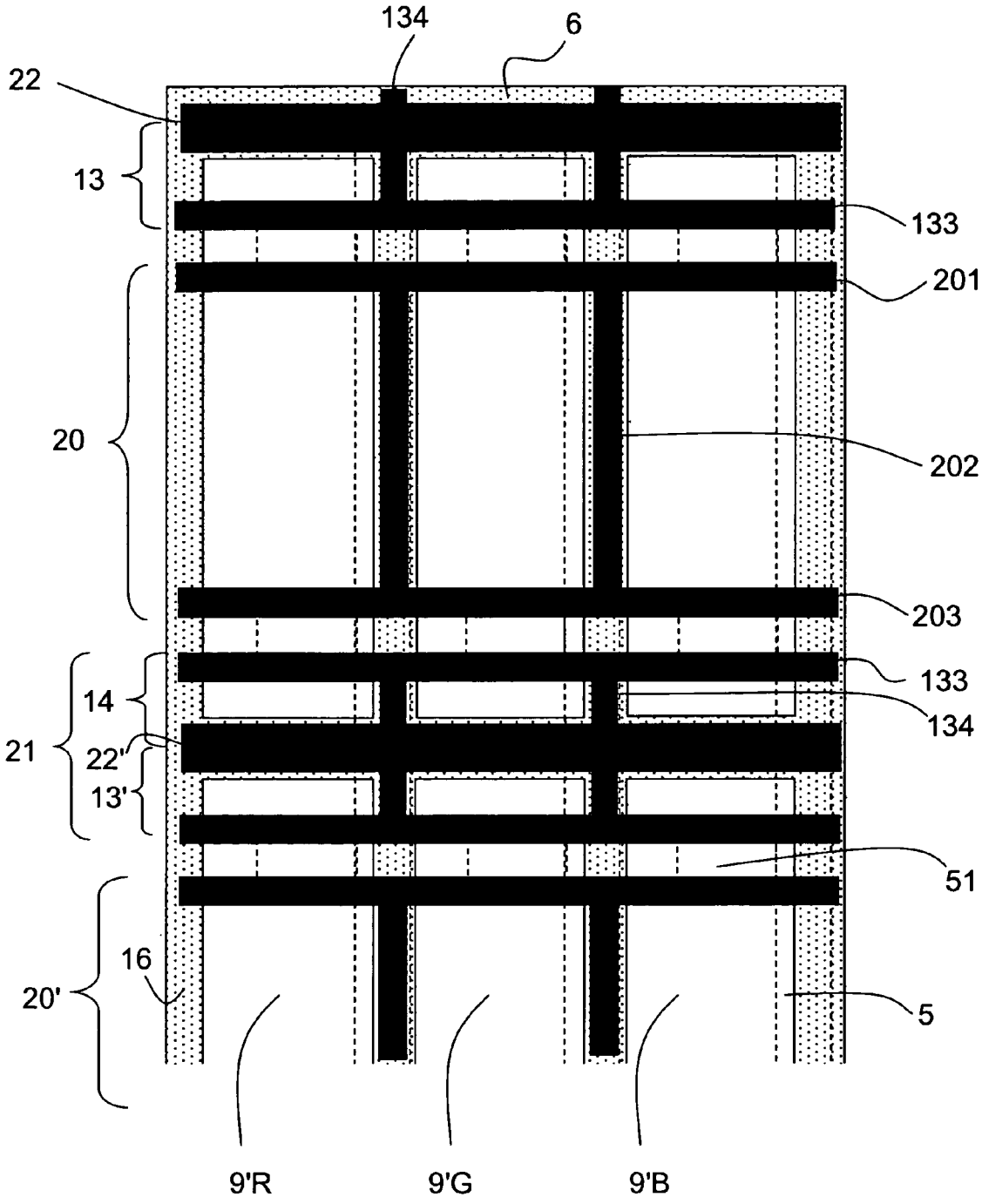
FIG. 9 shows a variant of FIG. 7, with a central electrode of large width.

FIG. 9 shows a variant of FIG. 7 (the same references of the components) with a central electrode 20 whose width is advantageously greater than that of each of the lateral electrodes 13 or 14; the opaque transverse branch-offs 202 of the central electode 20 and those 134 of the lateral electrodes 13, 14 are in this case placed on the barrier ribs 16 that define the cells; they may extend slightly along these barrier ribs. The present invention has been described with reference to a conventional AC plasma panel and to a mode of driving in which the sustain discharges involve a charge reversal on the surface of the dielectric; it is obvious to a person skilled in the art that the invention may apply to other types of display panels and to other modes of driving without departing from the scope of the claims appended hereto; the invention thus applies in particular to plasma panels driven at high frequency or radiofrequency, in which the sustain discharges are at least partly stabilized between the electrodes.

The invention claimed is:

1. Method for driving an AC image-display plasma panel with coplanar sustain discharges, and with memory effect, the said panel comprising:

a front tile and a rear tile, which are parallel and provide between them a space filled with a discharge gas;

one of the tiles comprising at least a first array of electrodes and the other tile comprising at least a second array of triads of electrodes, the general direction of which is approximately orthogonal to that of the electrodes of the first array;

each triad comprising two opposed lateral electrodes and one central electrode;

the spaces located at the intersections of the electrodes of the first array with the triads of electrodes of the second electrode array forming a matrix of light-discharge regions and of dots of the image to be displayed;

the electrodes of the triads being coated with a dielectric layer;

the said method comprising at least one sustain operation by applying a series of sustain voltage pulses between the electrodes of each triad so as to generate sustain discharges in each of the intersection regions in which it is desired to sustain a light discharge;

wherein, during the said sustain operation, the central electrodes of each of the said triads always act as anode;

wherein before or after each sustain operation, a selective addressing or erasing operation is applied only in each of the said intersection regions in which it is desired to sustain a light discharge during the said series, by applying at least one voltage pulse between the electrode of the said first array crossing the intersection region and the central electrode of the triad crossing the intersection region; and wherein, all of the regions supplied via the same triad forming one row of the panel, on any two adjacent rows through which a first triad on the one hand and a second triad on the other hand pass respectively, the lateral electrode of the first triad is electrically connected to the same potential as the closest lateral electrode of the second triad.

2. Method according to claim 1, wherein the width of the said central electrode is greater than the gaps separating and isolating the adjacent electrodes of the same triad.

3. Method according to claim 2, wherein the width of the said central electrode is greater than 80 μm.

4. Method according to claim 3, wherein the width of the said central electrode is between 100 and 200 μm.

5. Method according to claim 3, wherein the width of the said central electrode is greater than the width of the said lateral electrodes.

6. Plasma panel capable of being used for implementing the method according to claim 1, comprising:

a front tile and a rear tile, which are parallel and provide between them a space filled with a discharge gas;

one of the tile comprising at least a first array of electrodes and the other tile comprising at least a second array of triads of electrodes, the general direction of which is approximately orthogonal to that of the electrodes of the first array;

each triad comprising two opposed lateral electrodes and one central electrode;

the spaces located at the intersections of the electrodes of the first array with the triads of electrodes of the second electrode array forming a matrix of light-discharge regions and of dots of the image to be displayed;

the electrodes of the triads being coated with a dielectric layer;

means for controlling the discharges in each of the said intersection regions, especially by means of sustain operations;

wherein the said control means are designed so that, during the sustain operations, the central electrode always acts as anode; and as the closest lateral electrode of the second triad.

7. Plasma panel according to claim 6, wherein the width of the said central electrode is greater then the gaps separating and isolating the adjacent electrodes of the same triad.

8. Plasma panel according to claim 7, wherein the width of the said central electrode is greater than 80 μm.

9. Plasma panel according to claim 8, wherein the width of the said central electrode is between 100 and 200 μm.

10. Plasma panel according to claim 8, wherein the gaps separating and isolating the adjacent electrodes of the same triad are less than 80 μm and in that the spacing between the tiles providing the said discharge-gas-filled space is greater than 130 μm.

11. Plasma panel according to claim 10, wherein the width of the said central electrode is greater than 200 μm.

12. Panel according to claim 8, wherein the width of the said central electrode is greater than the width of each of the said lateral electrodes.

13. Plasma panel according to claim 6, wherein the said two electrically connected electrodes form an electrode common to two adjacent rows.

* * * * *